US005472349A

United States Patent [19]

Dixon et al.

[11] Patent Number: 5,472,349

[45] Date of Patent: Dec. 5, 1995

[54] SURFACE MOUNTABLE BOARD EDGE CONNECTOR

[75] Inventors: Dirk R. Dixon, Elizabethtown; Joseph W. McLay, Harrisburg, both of Pa.

[73] Assignee: The Whitaker Corporation, Wilmington, Del.

[21] Appl. No.: 332,164

[22] Filed: Oct. 31, 1994

[51] Int. Cl.[6] ..... H01R 9/09

[52] U.S. Cl. ..... 439/79

[58] Field of Search ..... 439/60, 79, 61, 439/62

[56] References Cited

U.S. PATENT DOCUMENTS

| | | | |
|---|---|---|---|
| 3,140,907 | 7/1964 | Davies | 339/17 |
| 3,160,455 | 12/1964 | Mayon et al. | 439/60 |
| 3,173,732 | 3/1965 | James | 339/17 |
| 3,215,968 | 11/1965 | Herrmann | 339/17 |
| 3,518,612 | 6/1970 | Dunman et al. | 339/19 |
| 3,731,252 | 5/1973 | McKeown et al. | 339/17 L |
| 3,783,433 | 1/1974 | Kurtz et al. | 339/17 C |
| 3,858,961 | 1/1975 | Goodman et al. | 339/176 MP |
| 3,993,383 | 11/1976 | Marino | 339/17 L |
| 4,298,237 | 11/1981 | Griffith et al. | 439/60 |
| 4,303,291 | 12/1981 | Dines | 339/17 B |
| 4,577,922 | 3/1986 | Stipanuk et al. | 339/176 MP |
| 4,991,666 | 2/1991 | Septfuns et al. | 439/79 |
| 4,998,886 | 3/1991 | Werner | 439/66 |
| 5,024,609 | 6/1991 | Piotunneck | 439/60 |
| 5,037,314 | 8/1991 | Bricaud et al. | 439/79 |
| 5,197,887 | 3/1993 | Davidge et al. | 439/60 |
| 5,203,725 | 4/1993 | Brunker et al. | 439/636 |
| 5,239,748 | 8/1993 | Hamilton | 439/60 |
| 5,259,767 | 11/1993 | Kurbikoff et al. | 439/60 |

*Primary Examiner*—Gary F. Pauman
*Assistant Examiner*—T. C. Patel

[57] ABSTRACT

A board edge electrical connector 60 includes a housing 12 having a plurality of first and second terminal members 64,74 each having a respective contact section 68,78 extending in a corresponding first or second row 66,76 from the board engaging face 18, the rows 66,76 being opposed to each other and defining a board receiving entrance 84 therebetween. Each first row contact section 68 includes respective contact surface 70 adapted to engage a corresponding circuit board 42 at a first position 43 on a first major board surface 40. Each second row contact section 78 is adapted to engage a second major board surface 46 at both a second position 53 proximate the board edge and a third position 54 farther from the board edge 52 than the first position 43 with each second row contact section 78 to be electrically connected to a corresponding board circuit 48 at at least one of the positions. The second and third positions 53,54 are axially offset from each other and from the first position 43 enabling the second row contact sections 78 to engage the board 38 under spring bias at respective positions 53,54 staggered from the first position 43. The arrangement altogether defines a stable board support with minimal rotation.

4 Claims, 7 Drawing Sheets

SURFACE MOUNTABLE BOARD EDGE CONNECTOR

FIELD OF THE INVENTION

This invention relates to circuit board connectors and more particularly to board edge connectors having surface mountable terminal members.

BACKGROUND OF THE INVENTION

One type of electrical connector used in today's electronic equipment is termed a "board edge" connector or "straddle mount" connector. The edge connector is provided for receiving a circuit board having a mating edge and a plurality of contact pads or conductors exposed adjacent the mating edge of the board. Most often, the terminal members in the connectors include cantilevered spring arms which are in biased engagement against the contact pads on the board. In some applications the board edge connector and the attached circuit board form a subassembly for a further device.

One such use for edge mount connectors is in the assembly of making memory cards or such devices. In making such cards a connector is mounted to a circuit board having a plurality of electronic components mounted thereto. The position of the board relative to the connector is dependent upon the amount of space needed for the various components mounted on the board. In many of the cards, the board needs to be offset from the center line of the connector to allow room for larger components on one side and smaller components on the other. Typically the terminal members have surface mounted contact leads and they are soldered to the respective circuit pads on the board. To assure proper assembly of the memory card, it is desirable that the electrical connector be parallel to the circuit board to enable the covers to be secured around the assembly and to prevent stress on the soldered terminal members. It is also desirable that the connector be able to support the board in the desired alignment without the need for additional mounting means or for through holes or other devices that require additional space on the circuit board.

SUMMARY OF THE INVENTION

The present invention is directed to alleviate the problems associated with the prior art by providing an improved offset straddle mount or edge connector having a stable board support with a minimal rotation. The board edge electrical connector includes a housing having a plurality of first and second terminal members disposed therein, the terminal members having respective contact sections extending in opposed first and second rows from a board engaging surface of the housing. The rows of contact sections define a board receiving entrance therebetween. Each of the first row contact sections include a contact surface adapted to engage a corresponding circuit of the circuit board at a first position. Each of the second row contact sections are adapted to engage a second major surface of the board at both a second position proximate the board edge and a third position farther from the board edge than the first position with each second contact sections electrically connected at at least one of the positions. The second and third positions are axially offset from each other and from the first position thereby enabling the second row contact to engage the board under spring bias at respective positions staggered from the first position. The arrangement altogether defines a stable board support having minimal rotation.

The present invention provides an advantage of having three points of support to improve the alignment of the connector with the board. The board being held in alignment with the connector facilitates assembly into further components such as memory cards or the like and also prevents damage of the contacts when the connector is mated to its complementary connector. An embodiment of the invention will be described by way of example with reference to the accompanying drawings.

BRIEF DESCRIPTION OF THE DRAWINGS

FIG. 6 is a cross-sectional view of the connector of FIG. 4 mounted to the circuit board with the card covers exploded therefrom.

DETAILED DESCRIPTION OF THE DRAWINGS

For purposes of illustration the invention the edge connector will be shown as part of a memory card assembly. For purposes of this invention the term memory cards is to be understood to include PCMCIA and similar style cards. It is to be understood that the board edge connector of the present invention is not limited to such assemblies.

Figure 1:
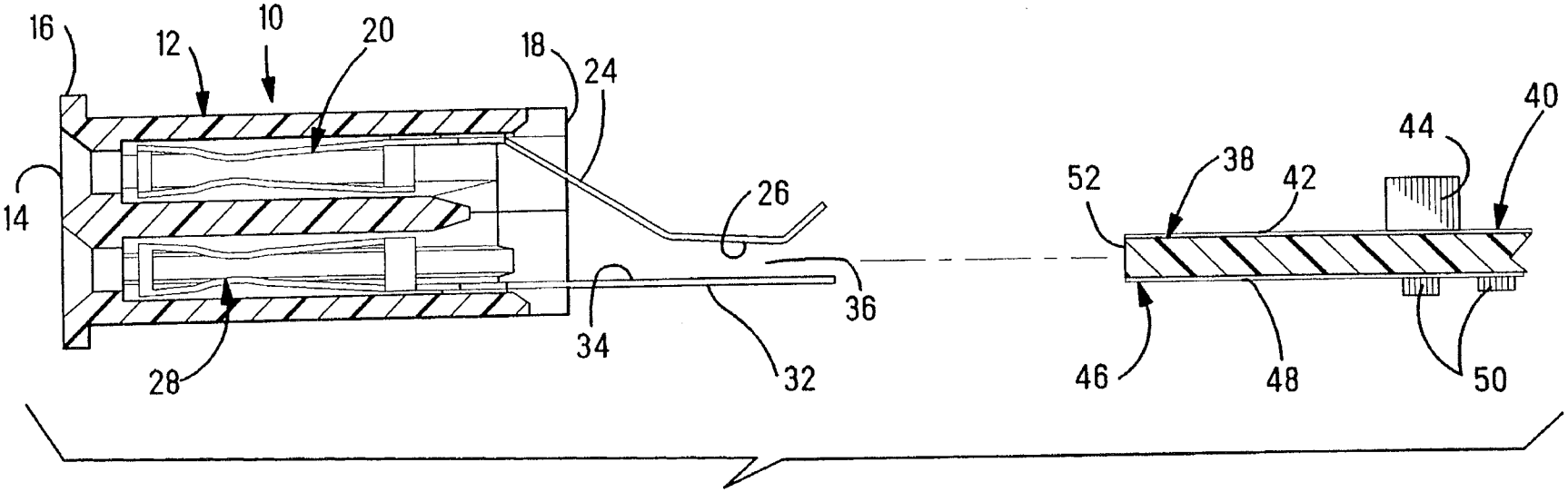
FIG. 1 PRIOR ART
FIG. 1 is a cross-sectional view of a prior art edge connector exploded from a circuit board.
Figure 2:
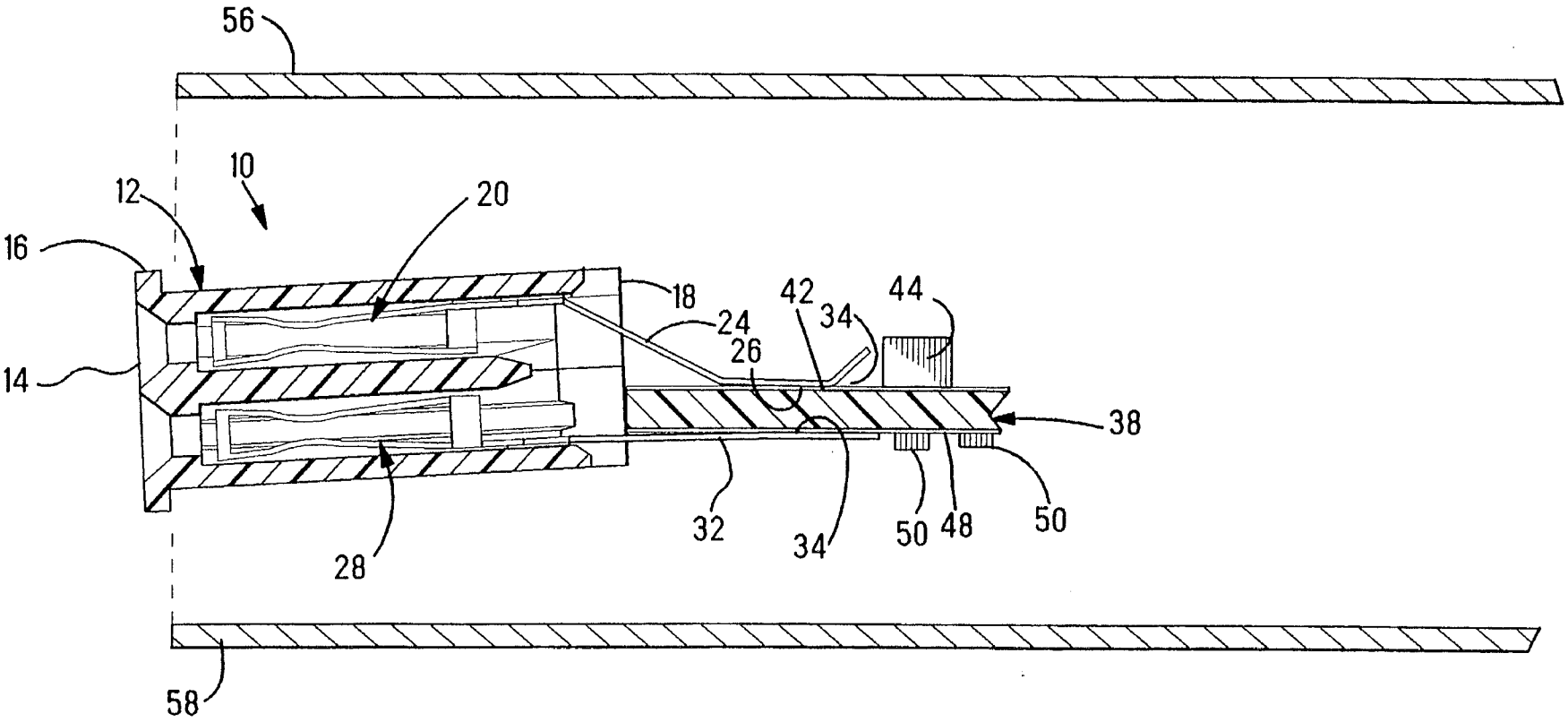
FIG. 2 PRIOR ART
FIG. 2 is a cross-sectional view of the prior art connector of FIG. 1 mounted to the circuit board with the card covers exploded therefrom.
Figure 3:
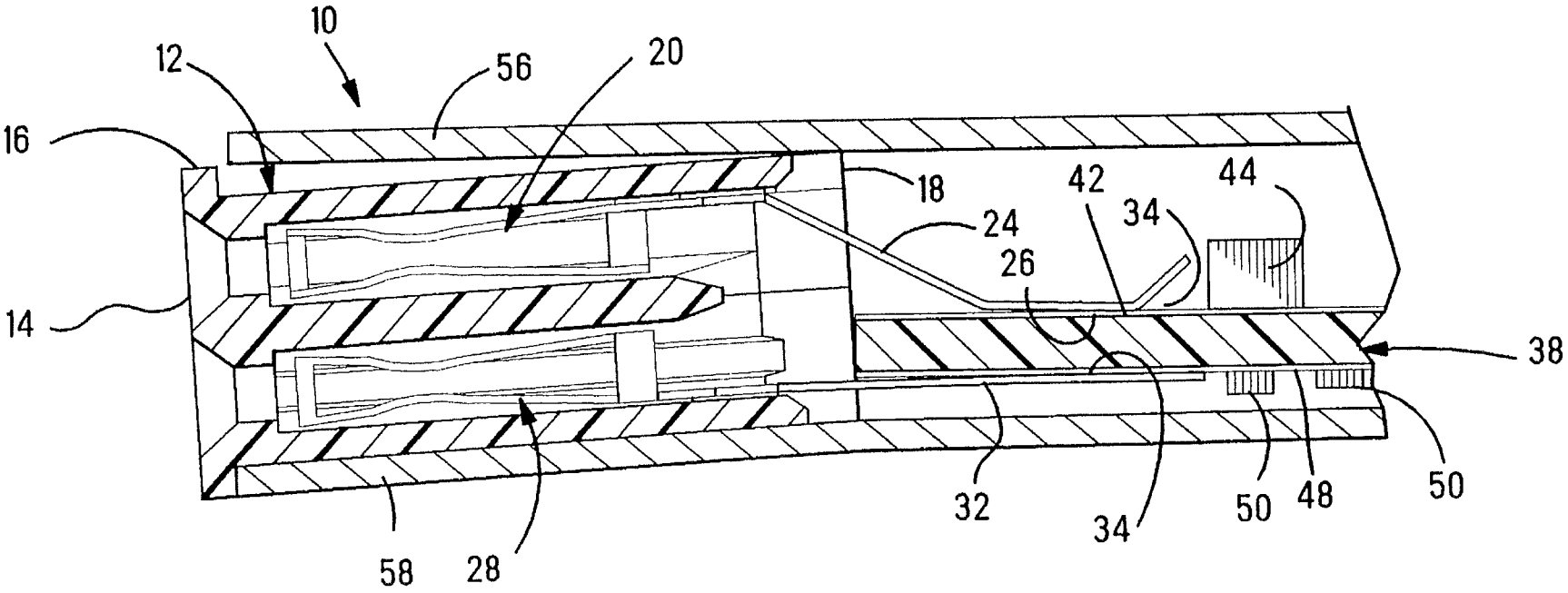
FIG. 3 PRIOR ART
FIG. 3 is a cross-sectional view of the connector and board of FIG. 2 having card covers attached thereto and illustrating the problem associated with the prior art.
Figure 4:
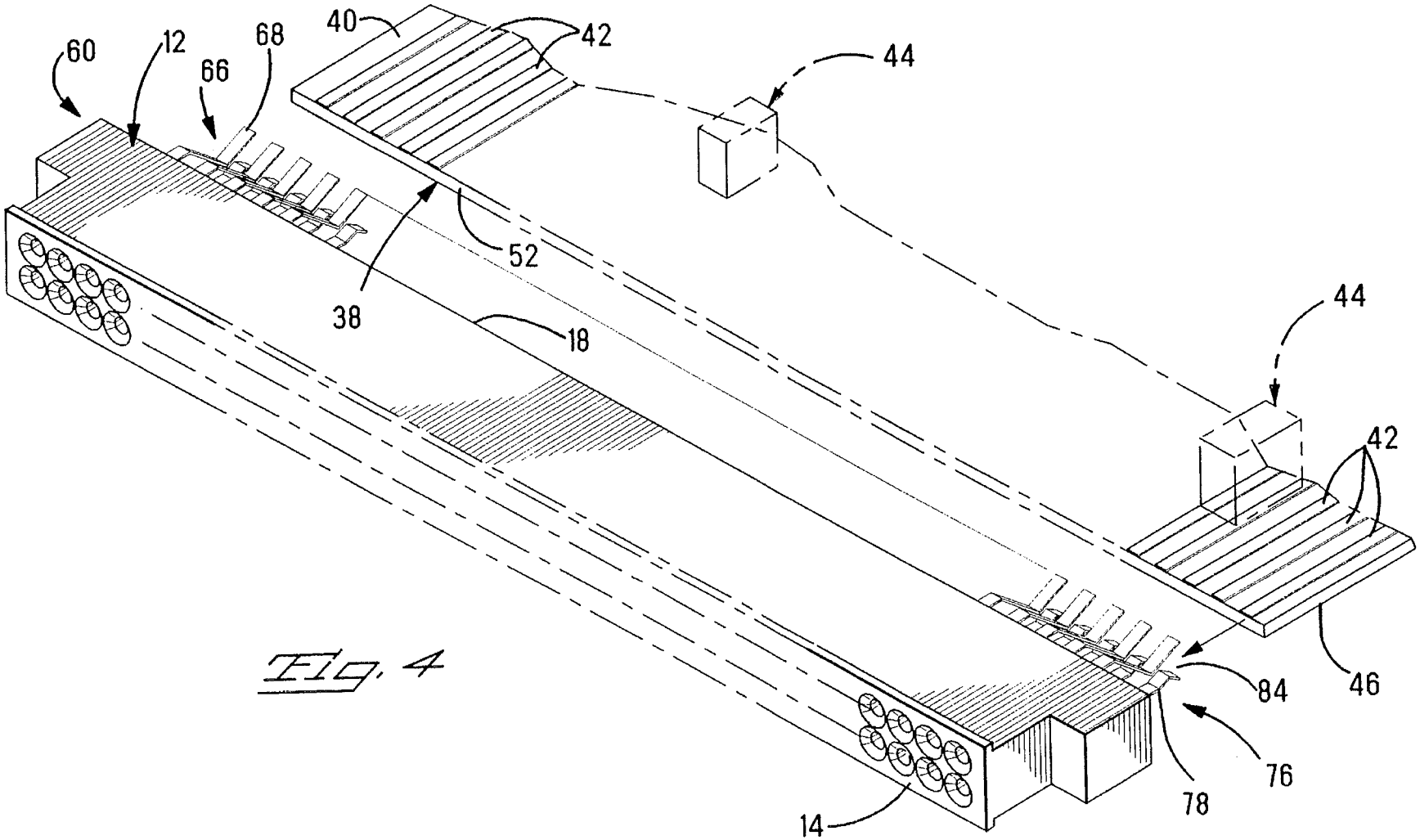
FIG. 4 is a perspective view of the connector of the present invention prior to mounting to a circuit board.

FIGS. 1, 2 and 3 illustrate the prior art connector and the problems associated therewith. Electrical connector 10 includes a housing 12 having a mating face 14 and a board engaging face 18. Connector 10 includes a plurality of first terminal members 20 having first contact sections or leads 24 extending from the board engaging face 18 of the housing 12 and a plurality of second terminal members 28 having second contact sections or leads 32 extending rearwardly from the board engaging face 18. The first and second contact sections 24,32 define a board receiving entrance 36 therebetween.

Connector 10 is adapted to be mounted to circuit board 38 having opposed major surfaces 40 and 46 and a corresponding plurality of first and second of circuits or circuit pads 42,48 on opposed major surfaces 40,46 thereof, proximate the leading edge 52, as best seen in FIG. 1. Circuit board 38 further includes a plurality of large components 44 mounted on the first major surface 40 and a plurality of smaller components 50 mounted on the lower surface thereof. As seen in FIG. 2, upon mounting prior art connector 10 to the circuit board 38 contact surface 26 of first contact section 24 engages a corresponding conductor 42 on the first major surface 40 of the board and the contact surface 34 of the second contact section or lead 32 engages a corresponding conductor 48 on the second major surface 46 of the board 38. After assembling the connector 10 to the board 38 as shown in FIG. 2, the contact surfaces 26,34 are mechanically and electrically secured to the respective circuits 42,48 by means of solder (not shown), thus securing connector 10 to the board. In the asymmetrical arrangement of card 38 with respect to the housing 12, as shown in FIG. 2, the unequal forces on opposite sides 40,46 of the board 38 cause the connector housing to rotate with the result that connector 10 is not parallel to the circuit board 38. When soldering takes place the connector 10 is secured in the nonaligned position.

FIG. 3 illustrates the use of the prior art edge or straddle connector 10 in a memory card or the like. The covers of a card frame are typically 0.010 inches thick. When the connector 10 and circuit board 38 are inserted between the covers 56,58, the circuit board 38 is held in position by supports (not shown) within the covers. The connector, however, being soldered in the rotated position remains out of alignment with the board. In assembling the "nonaligned" edge connector and board assembly into a memory card frame, the bottom cover 58 being thin will follow the shape of the connector and resile sufficiently to maintain contact with the lower edge of the connector. The top cover 56, on the other hand unless subjected to force will have a tendency to remain straight and will extend and may not be even with the flange or lip 16 at the mating face 14 of the housing 12. As can be seen from FIG. 3, forcing connector 10 into alignment with the board 38 after the contact surfaces 26,34 have been soldered to the corresponding circuits 42,48 on board 38 places stress on the soldered connections and may in fact break or fracture the soldered connections rendering the memory card inoperable.

The memory card is designed to be received in a card holder (not shown) having a complementary mating connector. The card holder includes a slot of a controlled thickness into which the card must fit. If a card, having a protruding cover that is high enough to interfere with the card holder slot, is inserted into the holder, the card may be forced into misalignment with the connector in the card holder. This could cause damage to the mating terminal members or cause the card cover to peel back and permanently damage the card.

The improved edge mount connector of the present invention is illustrated in FIGS. 4 through 7. For purposes of illustrating the invention the same housing 12 and corresponding numbers have been used as in the previous discussion. Connector 60 includes a housing 12 having a mating face 14 and a board engaging face 18. Connector 60 includes a plurality of first terminal members 64 having a row 66 of first contact sections or leads 68 extending from the board engaging face 18 and a plurality of second terminal members 74 having a second row 76 of second contact sections or leads 78 extending rearwardly from the board engaging face 18. The connector 60 is designed to be mounted to a circuit board 38 having the same construction as previously described.

Figure 5:
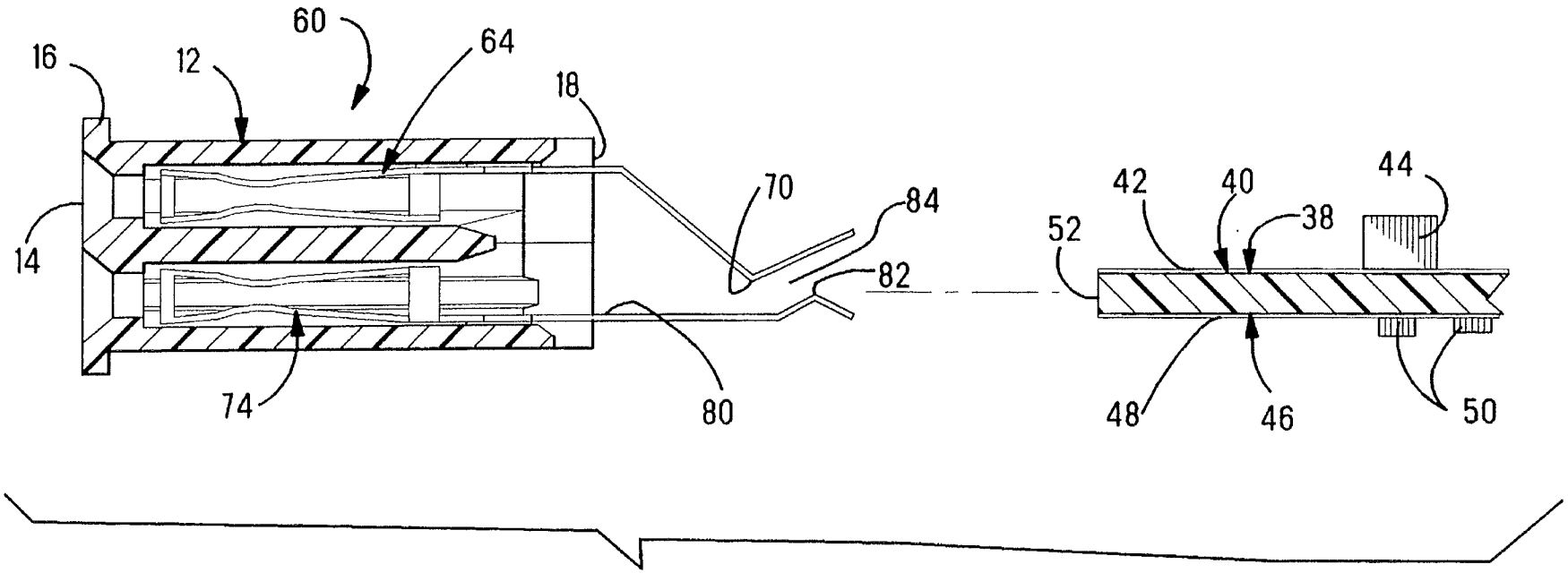
FIG. 5 is a cross-sectional view of the edge connector of the present invention exploded from a circuit board.
Figure 5:
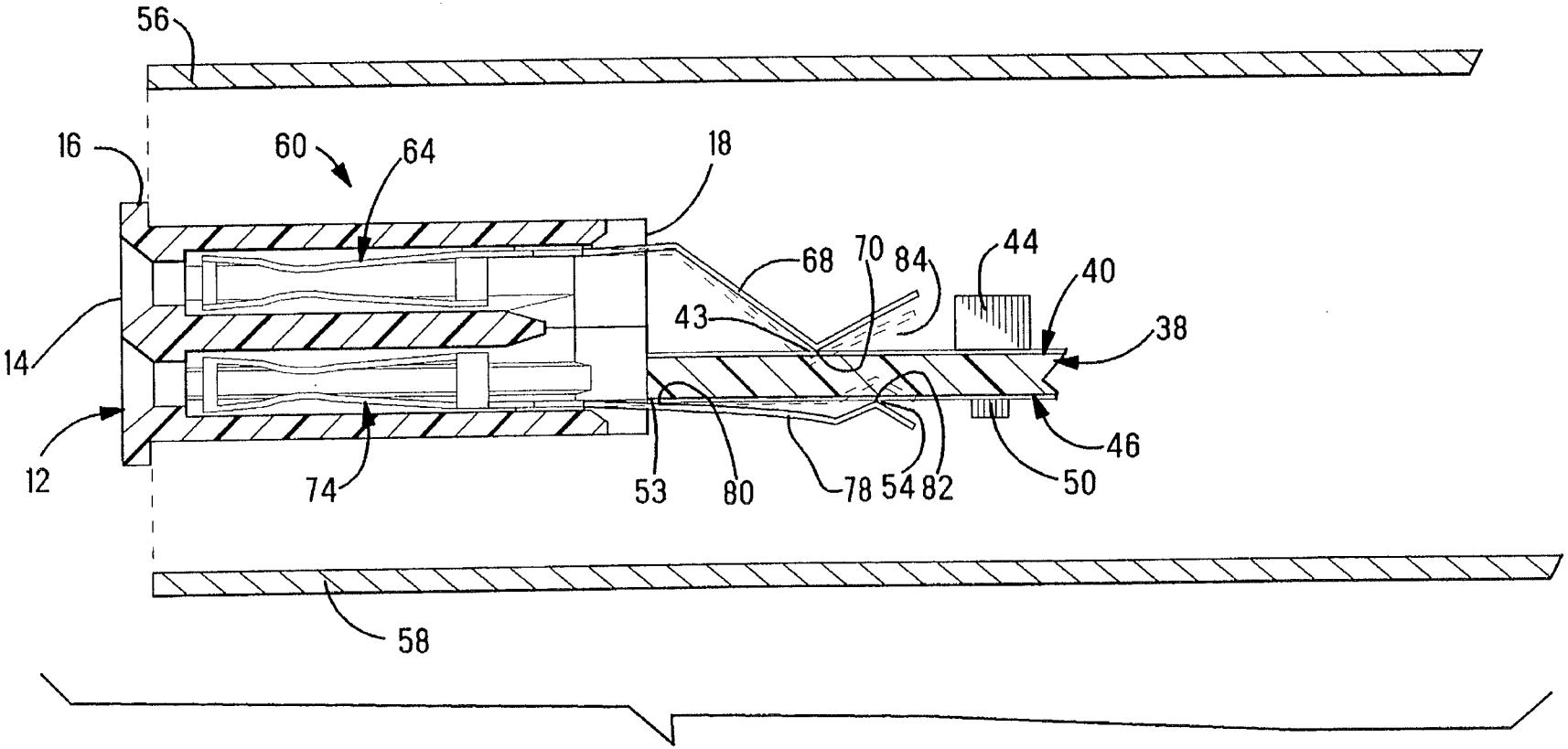

FIGS. 5 and 6 respectively, illustrate connector 60 prior to and after being mounted to the circuit board 38. Each of the first row contact sections 68 includes a contact surface 70 which engages the first major surface 40 of the circuit board 38 at 43. First position 43 is a selected distance from the leading edge 52 of the board 38. Each of the second contact sections 78 engage the second major board surface 46 at second and third positions 53,54 respectively. The second position 53 is at least proximate the leading edge 52 of the board 38 and the third position 54 is farther from the board edge 52 than the first position 43. The second and third positions 53,54 are thereby axially offset from each other and from the first position 43 and engage the board 38 under spring bias at respective positions 53,54 staggered from the first position 43. The arrangement altogether defines a stable board support having minimum rotation.

Figure 7:
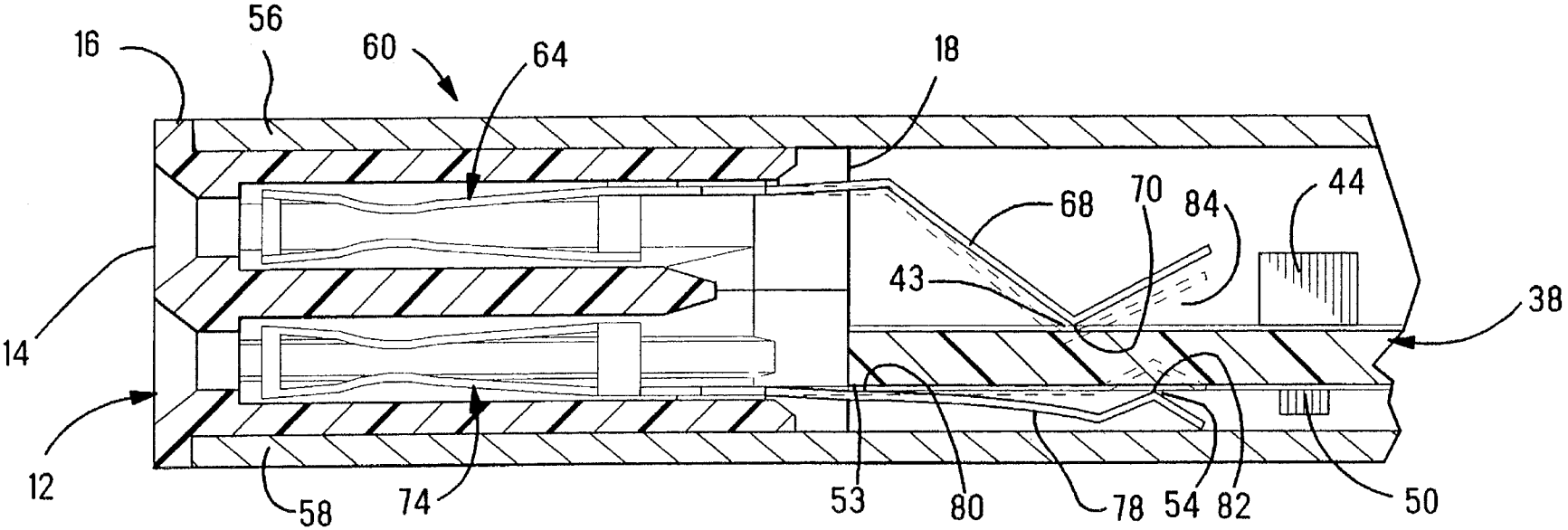
FIG. 7 is a cross-sectional view of the connector and board of FIG. 6 with the card covers attached thereto.

FIG. 7 illustrates the alignment of the connector 60 and board 38 when used in assembling it a memory card having respective covers 56 and 58. As shown in this Figure, top cover 56 is aligned with the flange 16 at the mating face 14 of the connector 60 and the lower cover 58 is aligned with the flange 16 extending from the lower edge of connector 60. The result and card assembly presents no protruding edges or gaps as shown with respect to prior art connector 10 in FIG. 3 and thus presents no problems when being mated with the complimentary connector (not shown). Since the housing 12 is in parallel alignment with the board 38, no stress is placed on the soldered joints as the memory card is assembled.

The present invention additionally has the advantage that the connector can support the board in the desired alignment without the need for specialized hold down devices on the connector or through holes in the board all of which would require additional board space.

It is thought that the edge connector of the present invention and many of its attended advantages will be understood from the foregoing description. It is apparent that various changes may be made in the form, construction and arrangement of parts thereof without departing from the spirit or scope of the invention, or sacrificing all of its material advantages.

We claim:

1. An electrical connector including a housing having a mating face and a board engaging face and plurality of first and second terminal members disposed therein, each of said first terminal members having a respective contact section extending in a first row from said board engaging face and each of said second terminal members having a respective contact section extending in a second row from said board engaging face, said first and second rows being opposed to each other and defining a board receiving entrance therebetween;

each of said first row contact sections including respective contact surface adapted to engage a corresponding circuit at a first position on a first major surface of a circuit board, said first position being a selected distance from an edge of said board;

each of said second row contact sections being adapted to engage a second major surface of said circuit board only at spaced apart second and third positions from said edge of said board, said second position being at least proximate to said board edge and said third position being farther from said board edge than said first position, each of said second row contact sections including a contact surface adapted to engage a corresponding circuit on said second board surface at at least one of said second and third positions;

whereby said second and third positions are axially offset from each other and from said first position enabling said second row contact sections to engage said board under spring bias at respective positions staggered from said first position and the arrangement altogether defining a stable board support with minimal rotation.

2. The electrical connector of claim 1 wherein leading ends of said first and second contact sections diverge at said board receiving entrance.

3. The electrical connector of claim 1 wherein each of said second contact sections has a sharply defined bend which engages said board at said third position.

4. The electrical connector of claim 1 wherein each of said first contact sections are laterally offset from a corresponding body portion of the respective said first terminal member.

* * * * *